US007113146B2

(12) United States Patent
Pearlman et al.

(10) Patent No.: US 7,113,146 B2
(45) Date of Patent: Sep. 26, 2006

(54) BROADBAND MONOPOLE

(75) Inventors: Ronald A. Pearlman, Hazelwood, MO (US); Curtis E. Larson, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/611,207

(22) Filed: Jun. 30, 2003

(65) Prior Publication Data

US 2004/0263415 A1 Dec. 30, 2004

(51) Int. Cl.
*H01Q 1/24* (2006.01)

(52) U.S. Cl. ..... 343/895; 343/702

(58) Field of Classification Search ..... 343/895, 343/702, 790, 791

See application file for complete search history.

(56) References Cited

U.S. PATENT DOCUMENTS 4,435,713 A * 3/1984 Gasparaitis et al. ..... 343/702
5,231,412 A * 7/1993 Eberhardt et al. ..... 343/790
6,094,178 A * 7/2000 Sanford ..... 343/895
6,320,552 B1 * 11/2001 Volman et al. ..... 343/772
6,384,798 B1 * 5/2002 Barta et al. ..... 343/895
6,441,795 B1 * 8/2002 Volman ..... 343/786
2003/0043080 A1 * 3/2003 Saito et al. ..... 343/702

* cited by examiner

*Primary Examiner*—Trinh Dinh
*Assistant Examiner*—Huedung X. Cao
(74) *Attorney, Agent, or Firm*—Lee & Hayes, PLLC

(57) ABSTRACT

A broadband monopole is preferably formed as a single arm helical winding formed from copper, aluminum, or other suitable materials. The monopole is embedded in a lossy dielectric material that may include, for example, a potting material and a polyurethane resin or carbon-loaded ceramic shell. In alternate embodiments, the helical winding may be used without the dielectric material, although such an embodiment is not preferred because the input impedance is oscillatory and difficult to match. The resulting antenna operates over an extremely broad band and provides very uniform input impedance.

20 Claims, 2 Drawing Sheets

BROADBAND MONOPOLE

FIELD OF THE INVENTION

This invention relates generally to antennas, and, more specifically, to broadband monopole antennas.

BACKGROUND OF THE INVENTION

A monopole antenna is half of a dipole, operated in conjunction with its image in a conducting ground plane perpendicular to the dipole. Monopoles are often useful as vehicle antennas where the ground plane is the surface of the vehicle. A monopole may be formed in a variety of sizes and shapes, depending on a particular application.

Monopole antennas are intrinsically narrow band, and the development of a broadband monopole that will operate across a wide frequency band presents a design challenge. Producing a broadband monopole that will achieve relatively uniform omnidirectional gain with input impedance matched across the entire bandwidth presents an even greater design challenge.

An additional hurdle is presented when the broadband monopole is sought to be used on an aircraft, particularly including a relatively small aircraft. Such a design must not only accomplish broadband, omnidirectional gain, and impedance matching, but must not degrade aerodynamic performance. Accordingly, there is a need for an improved broadband monopole antenna suitable for use on small aircraft.

SUMMARY OF THE INVENTION

The present invention is a broadband monopole preferably formed as a single arm helical winding. In a preferred form, the monopole is embedded in a lossy dielectric material and encased in a suitable covering.

In alternate embodiments, the helical winding may be used without the dielectric material, although such an embodiment is not preferred because the input impedance is oscillatory and difficult to match.

In accordance with other preferred aspects, the helical winding is formed from copper, aluminum, or other metals. The dielectric material is preferably a standard potting material encased in a polyurethane resin shell or carbon-loaded ceramic shell.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
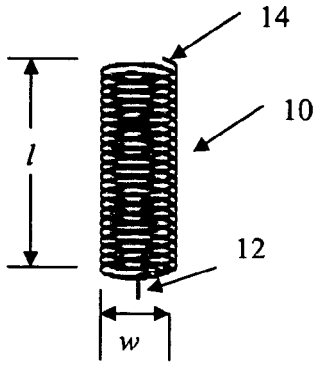
FIG. 1 is a perspective view of a helical winding broadband monopole not encased in a dielectric.

With reference to FIG. 1, a helical winding broadband monopole is shown. The monopole 10 is formed from copper wire, aluminum wire, or other suitable antenna materials. It includes a first end 12 and a second end 14, with a plurality of windings of the wire between the first end and the second end to form a helix.

In the preferred form, the helical winding includes 22 turns. A greater or lesser number of windings is also possible, with fewer windings reducing the bandwidth of the antenna and a greater number of windings making the antenna too lossy. Without limiting the scope of the invention, a helix with between 12 and 50 turns should produce a suitable antenna.

In the preferred form, the antenna is intended to be incorporated into a small vehicle such as an aircraft. Accordingly the preferred antenna includes a length l and a width w, where the length is between one and two inches and the width is about 0.5 inches. In an embodiment corresponding to the performance illustrated in FIGS. 3A and 3B, the length is about 1.2 inches, the spacing between each of the turns of the helix is about 0.05 inches, and the width is about 0.33 inches.

Figure 3A:
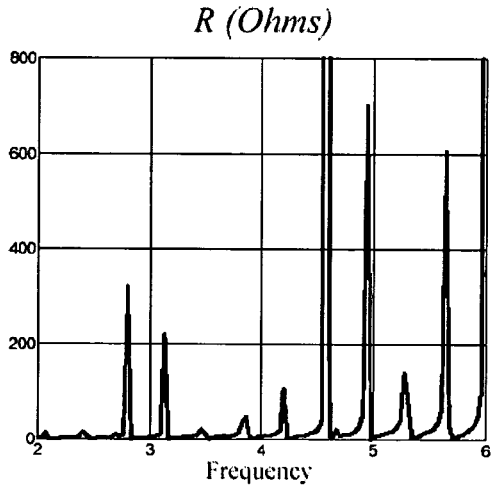
FIG. 3A is a graph of input impedance for the monopole of FIG. 1.
Figure 3B:
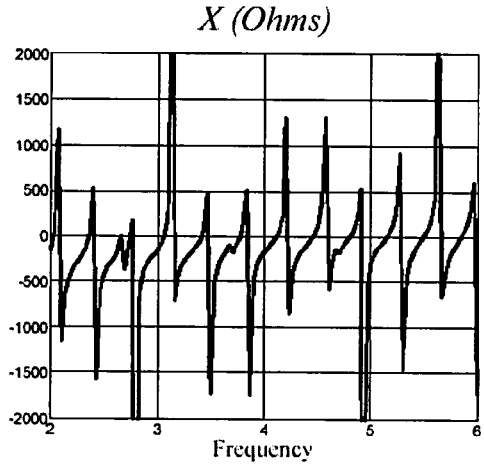
FIG. 3B is a graph of input reactance for the monopole of FIG. 1.

The performance of the monopole of FIG. 1 is illustrated in FIGS. 3A and 3B, depicting the input resistance and reactance, respectively. As shown in FIGS. 3A and 3B, the input impedance is highly oscillatory and reactive, making it very difficult to match the antenna with the circuitry it is coupled to.

Figure 2:
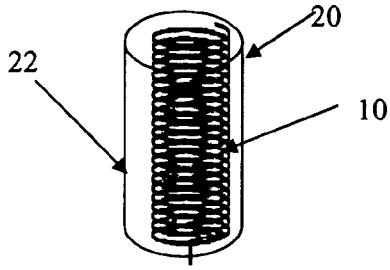
FIG. 2 is a perspective view of a preferred broadband monopole in accordance with this invention.

In order to overcome the impedance matching problem, the helical winding broadband monopole of FIG. 1 is encased in a dielectric, as shown in FIG. 2. The dielectric includes an outer shell 20 and may optionally include an internal potting material within the shell 20. The shell 20 is preferably constructed from polyurethane resin or a carbon-loaded ceramic material, and fully surrounds the helix 10. In conjunction with the embodiment described above in which the length of the helix is 1.2 inches and the width 0.33 inches, the shell 20 may be cylindrical having a diameter of about 0.36 inches, and a height of about 1.4 inches. It further has a dielectric constant of 6 and a loss tangent of 0.67, where the loss tangent $=2\sigma/(\in v)$, and $\sigma$ is the electrical conductivity, $\epsilon$ is the dielectric constant, and v is the frequency. While carbon-loaded ceramic is the preferred material for the shell 20, other materials having similar dielectric properties may also be used.

In addition, the dielectric shell 20 may include a potting material 22 filling the interior of the shell. The potting material is preferably lossy, having characteristics similar to those of the shell.

Figure 4:
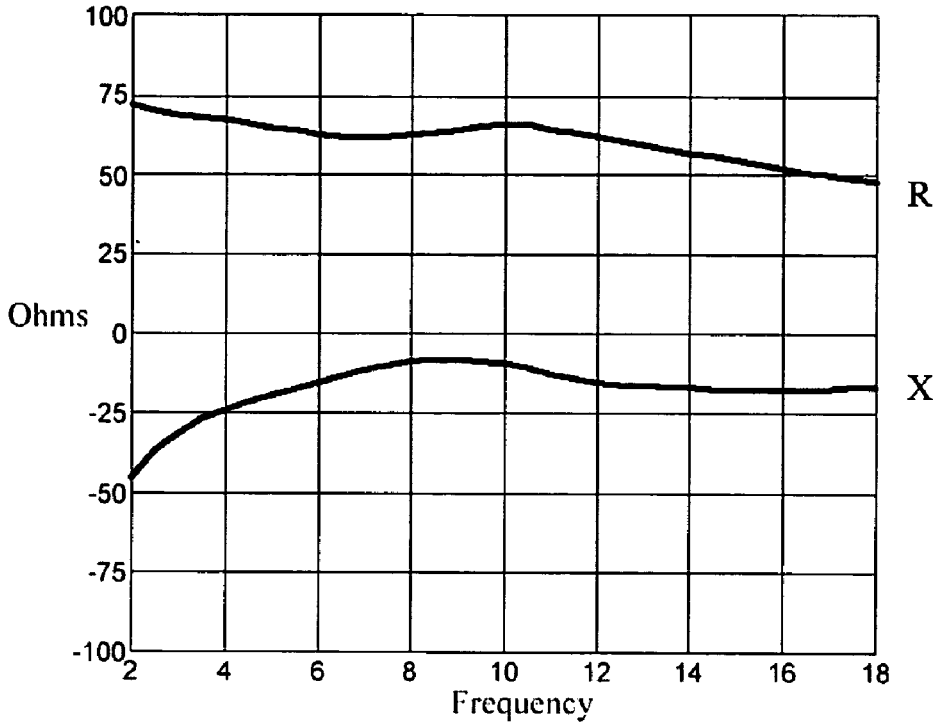
FIG. 4 is a graph of input impedance for the monopole of FIG. 2.
Figure 5:
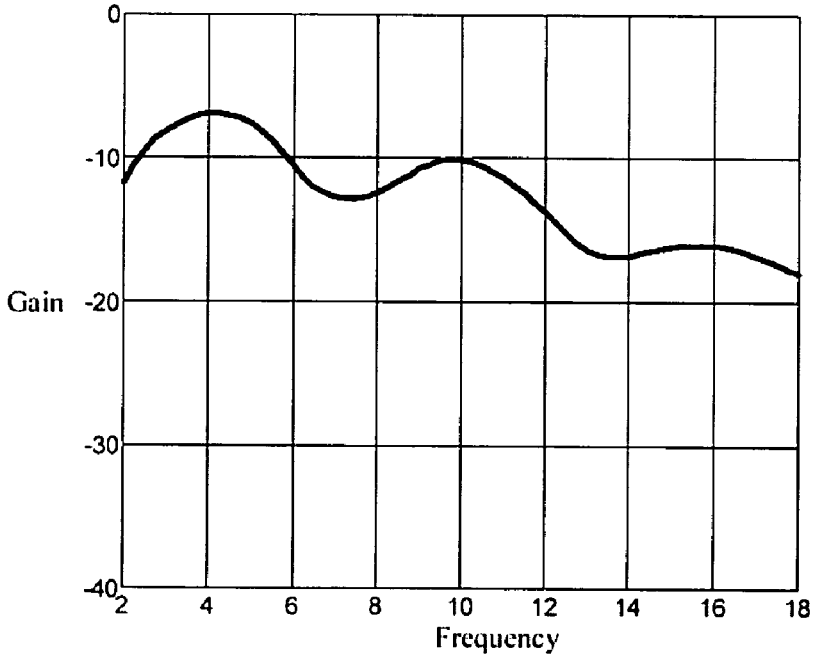
FIG. 5 is a graph of antenna gain for the monopole of FIG. 2.

The performance of the preferred broadband monopole of FIG. 2 is shown in FIGS. 4 and 5. With reference to FIG. 4, the input impedance is relatively uniform, and certainly much more so than the monopole without the dielectric shell. Consequently, the broadband monopole of FIG. 2 is very easy to impedance match with the circuitry to which the antenna is coupled. With reference to FIG. 5, the broadband monopole of FIG. 2 is relatively inefficient but operates fairly uniformly over an extremely broad band.

In operation, the first end 12 of the helix is connected to an applicable circuit using an appropriate connector such that the signals received by the antenna are coupled to any desired circuitry for processing.

While the preferred embodiment of the invention has been illustrated and described, as noted above, many changes can be made without departing from the spirit and scope of the invention. For example, the number of turns and length of the helix can be varied. While the monopole is intended to operate over a very broad band, the design can be tailored in size to target a desired band center, with the length being related to the received frequencies. Likewise, the broadband monopole can be formed from a variety of materials and contained in a variety of dielectric materials in order to accomplish the desired result of broadband coverage and impedance matching. Accordingly, the scope of the invention is not limited by the disclosure of the preferred embodiment. Instead, the invention should be determined entirely by reference to the claims that follow.

What is claimed is:

1. A broadband monopole antenna, comprising:

a helical monopole having a first end and a second end, the monopole including a plurality of windings between the first end and the second end to form a helix;

a dielectric material encasing the monopole that includes a carbon-loaded ceramic shell enclosing the monopole, the carbon-loaded ceramic shell having a relatively high dielectric constant and a substantial loss tangent to reduce efficiency, wherein the dielectric constant of the carbon-loaded ceramic shell is matched to the helical monopole such that the input impedance of the monopole antenna is relatively uniform across a broad frequency band; and a potting material disposed within the carbon-loaded ceramic shell and surrounding the helical monopole.

2. The broadband monopole of claim 1, wherein the shell is substantially cylindrical in shape.

3. The broadband monopole apparatus of claim 1, wherein the helical monopole is formed from a metal wire.

4. The broadband monopole of claim 3, wherein the shell is formed from polyurethane resin.

5. The broadband monopole of claim 1, wherein the carbon-loaded ceramic shell comprises a carbon-loaded ceramic material having a dielectric constant of about 6 and a loss tangent of about 0.67.

6. The broadband monopole of claim 1, wherein the helical monopole comprises between 12 and 50 windings.

7. The broadband monopole of claim 1, wherein the helical monopole comprises 22 windings.

8. The broadband monopole of claim 7, wherein the helical monopole is about 1.2 inches long and about 0.33 inches wide, and further wherein the shell is about 0.36 inches in diameter and about 1.4 inches in length.

9. The broadband monopole of claim 8, wherein the wire comprises a copper wire.

10. The broadband monopole of claim 8, wherein the wire comprises an aluminum wire.

11. A broadband monopole antenna, comprising:

a means for receiving an omnidirectional broadband signal;

a means for impedance matching the receiving means such that the input impedance of the monopole antenna is relatively uniform across a broad frequency band, the receiving means further comprising a dielectric outer shell enclosing the receiving means, the dielectric outer shell including a carbon-loaded ceramic shell having a substantial loss tangent to reduce efficiency; and a potting material disposed within the dielectric outer shell and surrounding the receiving means.

12. The broadband monopole of claim 11, wherein the shell is substantially cylindrical in shape.

13. The broadband monopole of claim 11, wherein the means for receiving comprises a metal wire.

14. The broadband monopole of claim 11, wherein the carbon-loaded ceramic shell is formed from a carbon-loaded ceramic material having a loss tangent of about 0.67.

15. The broadband monopole of claim 14, wherein the carbon-loaded ceramic shell includes a carbon-loaded dielectric material having a dielectric constant of about 6.

16. The broadband monopole of claim 13, wherein the metal wire further comprises a first end and a second end and a plurality of windings between the first end and the second end to form a helix.

17. The broadband monopole of claim 16, wherein the helix comprises 22 windings.

18. The broadband monopole of claim 17, wherein the helical monopole is about 1.2 inches long and about 0.33 inches wide, and further wherein the shell is about 0.36 inches in diameter and about 1.4 inches in length.

19. The broadband monopole of claim 17, wherein the wire comprises a copper wire.

20. The broadband monopole of claim 17, wherein the wire comprises an aluminum wire.

* * * * *